US007280773B2

(12) United States Patent
Uno

(10) Patent No.: US 7,280,773 B2
(45) Date of Patent: Oct. 9, 2007

(54) IMAGE FORMING APPARATUS FOR DETERMINING COMPLETION OF A TONER-END RECOVERY OPERATION

(75) Inventor: Mugijirou Uno, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 261 days.

(21) Appl. No.: 11/061,627

(22) Filed: Feb. 22, 2005

(65) Prior Publication Data

US 2005/0191067 A1 Sep. 1, 2005

(30) Foreign Application Priority Data

Feb. 27, 2004 (JP) ..... 2004-054758

(51) Int. Cl.
*G03G 15/08* (2006.01)

(52) U.S. Cl. ..... 399/27; 399/29; 399/49

(58) Field of Classification Search ..... 399/9, 399/24, 25, 27, 29, 30, 46, 49, 72
See application file for complete search history.

(56) References Cited

U.S. PATENT DOCUMENTS

| | | | | |
|---|---|---|---|---|
| 5,617,191 | A | 4/1997 | Murakami et al. | |
| 5,625,440 | A | 4/1997 | Matsumae et al. | |
| 5,768,665 | A | 6/1998 | Yamanaka et al. | |
| 5,826,144 | A | 10/1998 | Takenaka et al. | |
| 5,897,243 | A | 4/1999 | Komatsubara et al. | |
| 5,978,643 | A | 11/1999 | Uno | |
| 6,022,660 | A | 2/2000 | Uno | |
| 6,442,355 | B2 * | 8/2002 | Hasegawa et al. | 399/58 |
| 6,512,901 | B2 | 1/2003 | Uno | |
| 6,947,681 | B2 * | 9/2005 | Ogata | 399/58 |
| 6,987,934 | B2 * | 1/2006 | Bessho et al. | 399/27 |
| 7,013,096 | B2 * | 3/2006 | Ozawa et al. | 399/58 |
| 7,050,729 | B2 * | 5/2006 | Fujiwara | 399/27 |
| 2004/0136763 | A1 | 7/2004 | Murakami et al. | |

FOREIGN PATENT DOCUMENTS

| | | |
|---|---|---|
| JP | 9-90734 | 4/1997 |
| JP | 10-142935 | 5/1998 |
| JP | 2002-251063 | 9/2002 |
| JP | 2003-5608 | 1/2003 |
| JP | 3451470 | 7/2003 |
| JP | 2004-133084 | 4/2004 |
| JP | 2004-240129 | 8/2004 |

* cited by examiner

*Primary Examiner*—Hoan Tran
(74) *Attorney, Agent, or Firm*—Oblon, Spivak, McClelland, Maier & Neustadt, P.C.

(57) ABSTRACT

An image forming apparatus of the present invention includes a toner content controller configured to set the target value of a toner content sensor for determining, after a developing unit has been driven for a preselected period of time since the detection of the replacement of a toner cartridge, that a toner-end recovery operation has been completed. Subsequently, every time a preselected toner replenishing cycle is executed, the toner content controller determines whether or not the output voltage Vt of the toner content sensor has decreased below Vt10-0.1 V and determines, if the answer of this decision is positive, that a toner-end recovery operation has completed.

6 Claims, 11 Drawing Sheets

T SENSOR (HIGH TONER CONTENT)

(LOW TONER CONTENT)

IMAGE FORMING APPARATUS FOR DETERMINING COMPLETION OF A TONER-END RECOVERY OPERATION

BACKGROUND OF THE INVENTION

1. Field of the Invention

The present invention relates to a copier, printer, facsimile apparatus, plotter or similar image forming apparatus and more particularly to a toner content control system for an image forming apparatus of the type using a two-component type developer, i.e., a toner and carrier mixture.

2. Description of the Background Art

Accurate control over the toner content of a two-component type developer is one of prerequisites for an electrophotograpahic image forming apparatus of the type using such a developer. Japanese Patent Laid-Open Publication No. 1-154179, for example, discloses a toner content control system of the type maintaining replenishing fresh toner in accordance with the output of a toner content sensor. It has been customary with this type of toner content control system to add some circuit for reducing irregularity in the output of the toner content sensor, thereby confining the output of the toner content sensor in a preselected range, as taught in Japanese Patent Laid-Open Publication No. 63-58472.

However, the prior art toner content control system stated above has the following problem left unsolved. The density of an image formed by an electrophotographic image forming apparatus varies in accordance with the ambient temperature and humidity as well as developing conditions even when the toner content remains constant. This problem, which is extremely substantial, is ascribable to the fact that electrophotography develops a latent image by frictional electrification. To solve this problem, it is a common practice to form a reference pattern on a photoconductive element and set a target toner content and replenish toner in such a manner as to maintain the density of the reference pattern constant.

Generally, toner formed of denatured polyester resin is advantageous over toner formed by suspension polymerization in that its shape can be easily controlled and is therefore feasible for blade type cleaning. Also, such toner is free from the problem of toner formed by emulsion polymerization that a surfactant remains in toner or contaminates a photoconductive element and a developing roller, obstructing the frictional electrification of the toner.

However, a problem with toner formed by denatured polyester resin is that toner grains themselves are charged to weak positive polarity opposite to usual charge polarity and are therefore apt to decrease in charge when left unused over a substantial period of time. Another problem is that the toner must be agitated for a longer period of time than conventional toner to be fully charged after replenishment. An image forming apparatus of the type using the toner formed of denatured polyester resin and the toner content control forming a reference pattern has some problems that will be described specifically later.

Technologies relating to the present invention are also disclosed in, e.g., Japanese Patent Laid-Open Publication Nos. 2003-56508, 2002-251063, 10-186830, 9-90734 and 10-142935.

SUMMARY OF THE INVENTION

It is an object of the present invention to provide an image forming apparatus capable of maintaining an adequate toner content at all times even after a toner-end recovery operation, thereby obviating background contamination and other image defects and toner scattering.

It is another object of the present invention to obviate an occurrence that when a used, empty toner cartridge is again mounted to an image forming apparatus, the apparatus is caused to resume its operation with a low toner content and damaged by the resulting carrier deposition and scattering.

An image forming apparatus of the present invention includes a developing unit for developing a latent image formed on an image carrier with toner to thereby produce a corresponding toner image. A toner replenishing device includes a removable toner cartridge for replenishing toner to the developing unit. A toner content sensor senses the toner content of a developer stored in the developing unit in terms of the permeability of the developer. A pattern density sensor senses the reflection density of a reference pattern formed on the image carrier. A toner content controller calculates, based on the output of the pattern density sensor, the target value of the toner content sensor and so controls the toner replenishing device as to implement the target value. The toner content controller is capable of determining that the toner replenishing device has run out of toner and that the toner cartridge has been replaced. The toner content controller sets the target value for determining, after the developing unit has been driven for a preselected period of time since the detection of the replacement of the toner cartridge, that a toner-end recovery operation is completed.

Also, an image forming apparatus includes a developing unit for developing a latent image formed on an image carrier with toner to thereby produce a corresponding toner image. A toner replenishing device includes a removable toner cartridge for replenishing toner to the developing unit. A toner content sensor senses the toner content of a developer stored in the developing unit in terms of the permeability of the developer. A pattern density sensor senses the reflection density of a reference pattern formed on the image carrier. A toner content controller calculates, based on the output of the pattern density sensor, the target value of the toner content sensor and so controls the toner replenishing device as to implement the target value. The toner content controller is capable of determining that the toner replenishing device has run out of toner and that the toner cartridge has been replaced. On detecting the replacement of the toner cartridge, the toner content controller starts a toner-end recovery operation, checks the output of the pattern density sensor every time the toner replenishing device continuously performs a toner replenishing operation for a preselected period of time, and determines that the toner-end recovery operation has completed when the output of the pattern density sensor exceeds a preselected threshold value.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

To better understand the present invention, problems with an image forming apparatus of the type using the toner formed of denatured polyester resin and the toner content control forming a reference pattern, as stated earlier, will be described specifically. When the image forming apparatus is continuously operated to produce a great number of prints and then left unused, e.g., overnight, the output of a toner content sensor included in the apparatus is shifted toward a low toner content side than the day before. As a result, fresh toner is replenished in an excessive amount in order to correct such a shift.

Figure 1:
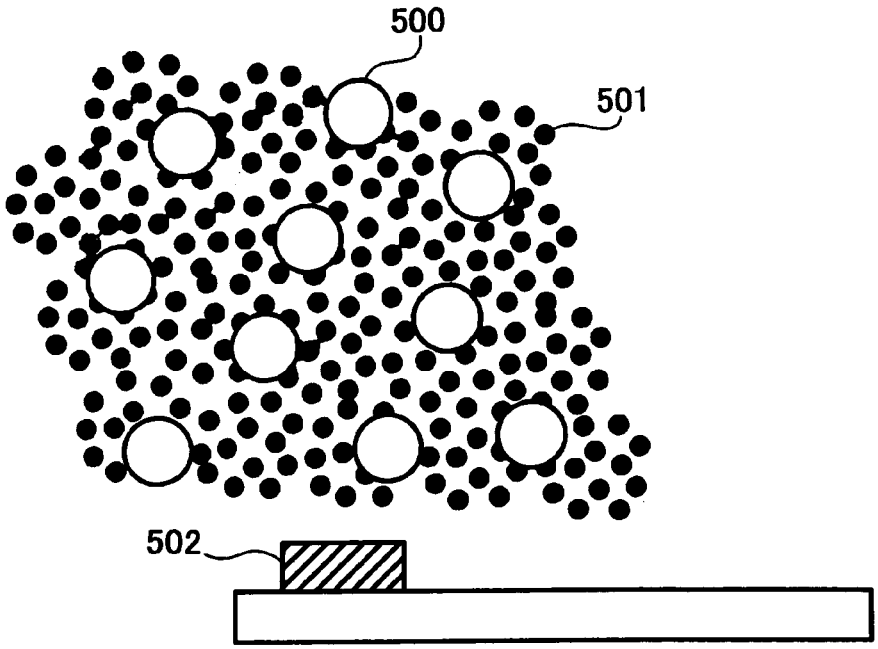
FIG. 1 shows toner grains and carrier grains, which constitute a developer together, existing in a high toner content condition.

Originally, a toner content sensor, or T sensor as sometimes referred to, measures a toner content in terms of the permeability of a magnetic carrier constituting the developer in combination with toner. More specifically, as shown in FIG. 1, when the toner content of the developer is high, a great amount of toner grains 501 exist between magnetic carrier grains 500 and enlarge the gaps between the carrier grains 500. As a result, the permeability of the carrier grains 500 and therefore the output voltage of a toner content sensor 502 drops.

Figure 2:
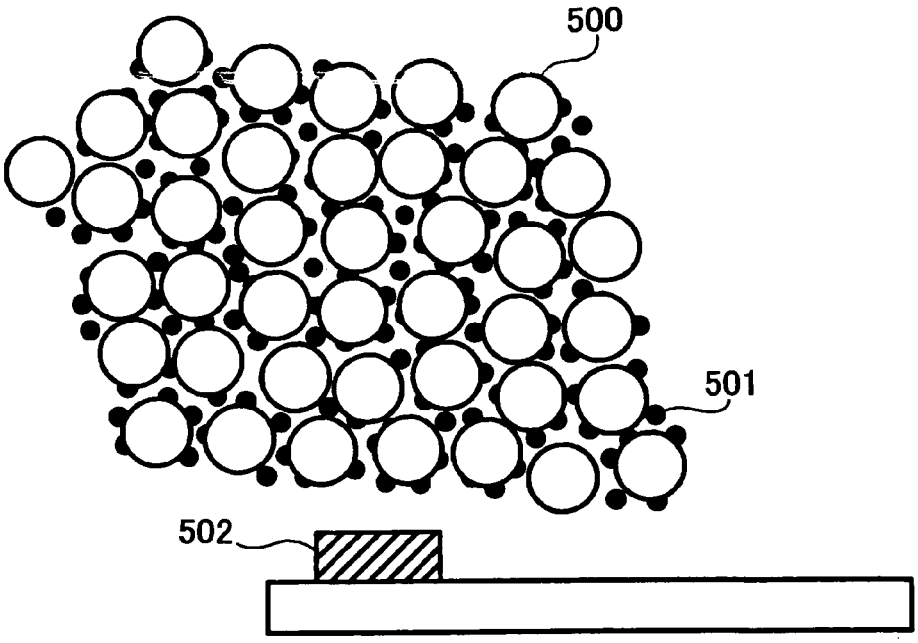
FIG. 2 shows the toner grains and carrier grains existing in a high toner content condition.
Figure 3:
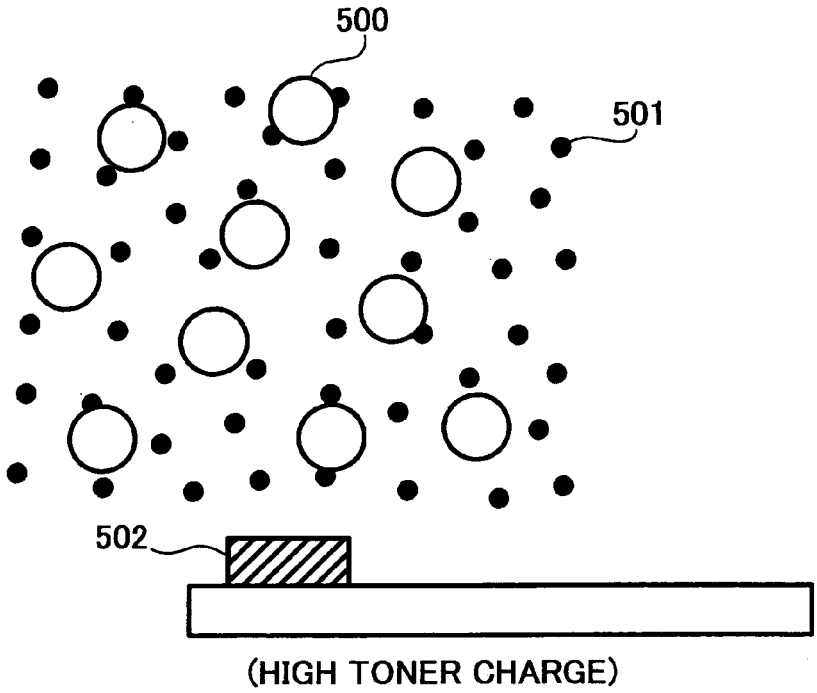
FIG. 3 shows the toner grains and carrier grains existing in a high toner charge condition.
Figure 4:
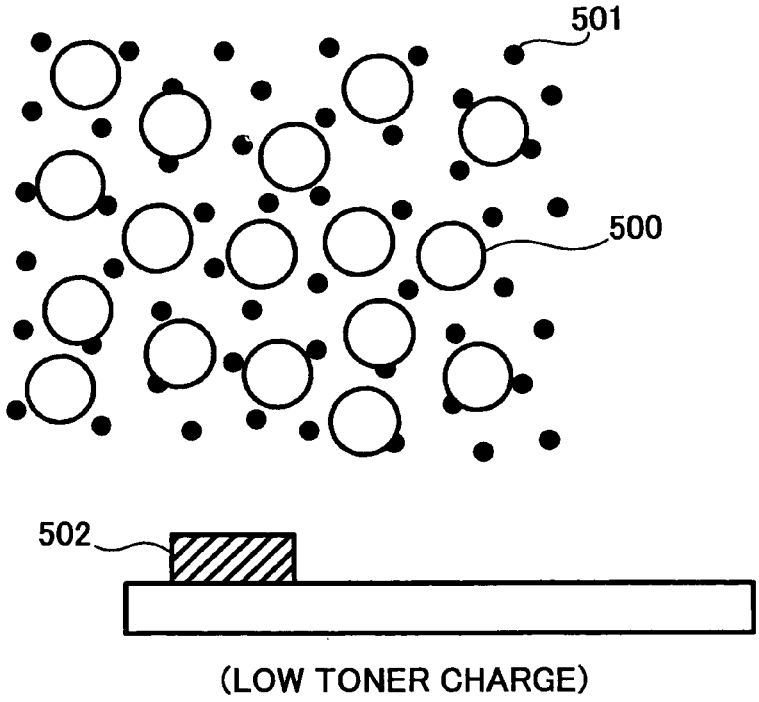
FIG. 4 shows the toner grains and carrier grains existing in a low toner charge condition.

Conversely, as shown in FIG. 2, when the toner content of the developer is low, the gaps between the carrier grains 500 are narrowed with the result that the permeability and therefore the output voltage of the toner content sensor 502 rises. However, when a great number of prints are continuously produced, the amounts of charge deposited on the carrier grains 500 and toner grains 501 increase, causing the carrier grains 500 and toner grains 501 to repel each other due to Coulomb's force. As a result, as shown in FIG. 3, the permeability and therefore the output voltage of the toner content sensor 502 drops despite that the toner content is not high. If the image forming apparatus is left unused overnight in such a condition, then the amounts of charge deposited on the carrier grains 500 and toner grains 501 decrease due to self-discharge. Consequently, as shown in FIG. 4, the gaps between the carrier grains 500 are narrowed and cause the output voltage of the toner content sensor 502 to rise. This erroneously indicates that the toner content is low, and causes fresh, uncharged toner to be replenished.

Figure 5:
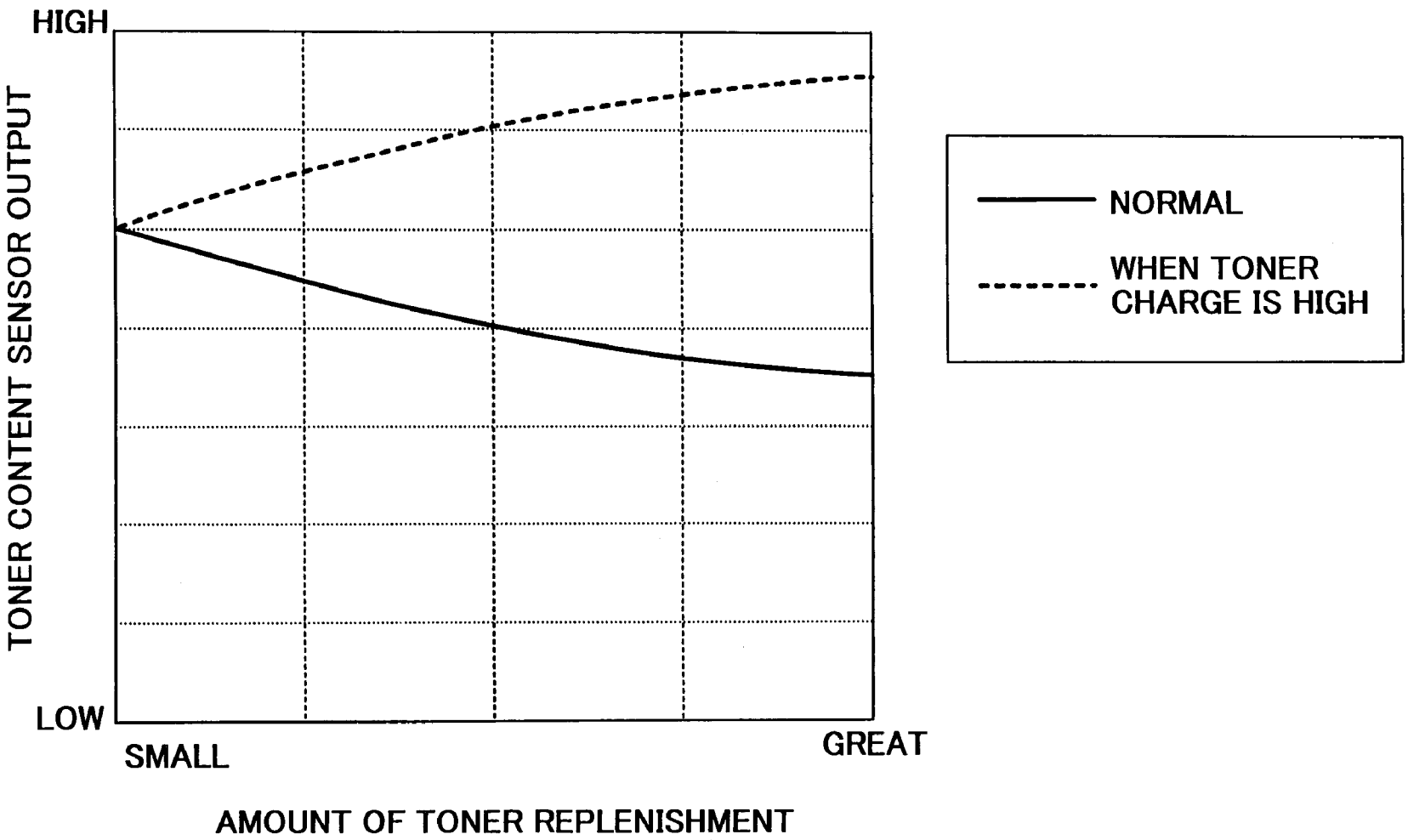
FIG. 5 is a graph showing a relation between the amount of toner replenished and the output voltage of a toner content sensor.

The uncharged toner thus replenished further reduces the amount of charge deposited on the carrier grains 500. Consequently, as shown in FIG. 5, the output voltage of the toner content sensor 502 starts rising despite the replenishment as if it indicates that the toner content has decreased, so that more uncharged toner is excessively replenished in accordance with the rise of the sensor output voltage. Such a vicious cycle results in abnormal, excessive replenishment of uncharged toner and brings about background contamination and toner scattering. Further, assume that when a toner-end condition that inhibits further printing is detected, i.e., a toner cartridge included in toner replenishing means runs out of toner, a spare toner cartridge is not available. Then, the image forming apparatus is, in many cases, left unused until the delivery of a new toner cartridge, aggravating the decrease in the amounts of charge of the toner grains and carrier grains ascribable to self-discharge.

Figure 6:
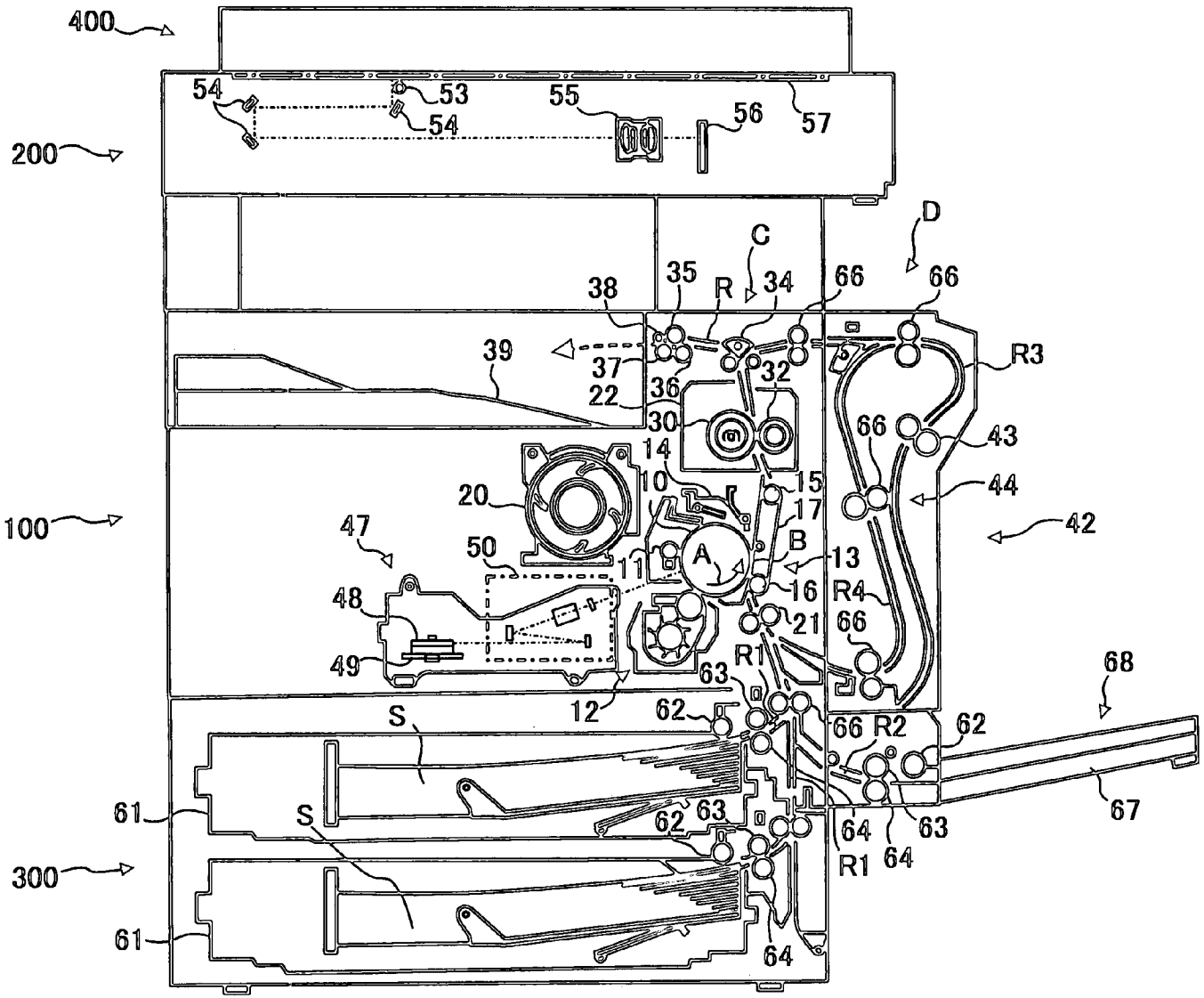
FIG. 6 is a front view showing an image forming apparatus embodying the present invention.

Referring to FIG. 6, an image forming apparatus embodying the preset invention is shown and implemented as a copier by way of example. As shown, the copier is generally made up of a copier body 100, a sheet bank 300 on which the copier body 100 is mounted, an image scanner or document reading device 200 mounted on the copier body 100, and an ADF (Automatic Document Feeder) 400 mounted on the image scanner 200. The ADF 400 is openable upward away from the image scanner 200 about a fulcrum, which is located at the rear side in the direction perpendicular to the sheet surface of FIG. 6.

A photoconductive element or image carrier implemented as a drum 10 is disposed in the copier body 100. Sequentially arranged around the drum 10 in the counterclockwise direction, as viewed in FIG. 6, are a charger 11, a developing unit 12, an image transferring unit 13 and a cleaning unit 14. The developing unit 12 stores toner produced by polymerization and includes a developing roller for depositing the toner on a latent image formed on the drum 10 to thereby produce a corresponding toner image. The image transferring unit 13 includes an image transfer belt 17 passed over an upper and a lower roller 15 and 16. The image transfer belt 17 is pressed against the circumference of the drum 10 at an image transfer position B.

A toner replenishing device or toner replenishing means 20 is arranged at the left-hand side of the charger 11 and cleaning unit 14, as viewed in FIG. 6, and replenishes fresh toner to the developing unit 12, as needed.

A sheet conveying device C is arranged in the copier body 100. When a sheet S is paid out from a sheet cassette 61 included in the sheet bank 300, which will be described later specifically, the sheet conveying device C conveys the sheet S upward to a stacking position via the image transfer position B.

More specifically, the sheet conveying device C includes a sheet feed path R1, a manual sheet feed path R2 and a sheet path R into which the two feed paths R1 and R2 merge. A registration roller pair 21 is positioned on the sheet path R at the upstream side in the direction of rotation of the drum 10. A fixing unit 22 is positioned on the sheet path R at the downstream side in the above direction, i.e., in a direction in which the image transferring unit 13 conveys the sheet S. The fixing unit 22 includes a heat roller or heating member 30 and a press roller or pressing member 32.

A path selector 34, an outlet roller 35, a first press roller 36, a second press roller 37 and a stiffen roller 38 are arranged on the sheet path R downstream of the fixing unit 22. Further, a stack section 39 for stacking consecutive sheets or copies S is located at the most downstream side.

A switchback unit 42 is mounted on the right side of the copier body 100, as viewed in FIG. 6, and includes a sheet conveying device D. The sheet conveying device D includes a reverse path R3 branching off the sheet path R at the path selector 34 and a reefed path R4. The reverse path R3 includes a pair of switchback rollers 43 and conveys the sheet S to a switchback position 44. The reefed path R4 again conveys the above sheet S from the switchback path 44 to the registration roller pair 21 on the sheet path R. The sheet conveying device D includes a plurality of roller pairs 66 for conveying the sheet S.

A laser writing unit 47 for writing an image is positioned at the left-hand side of the developing unit 12, as viewed in FIG. 6, and includes a laser, a polygonal mirror 48, a motor 49 for causing the polygonal mirror 48 to spin, and optics 50 including an fθ lens, although not shown specifically.

The image scanner 200 includes a light source 53, mirrors 54, an optical focusing lens 55 and a CCD (Charge Coupled Device) image sensor or similar image sensor 56. A glass platen 57 is mounted on the top of the image scanner 200.

The ADF 400, positioned above the glass platen 57, includes a document set tray and a document stack tray respectively located at a document feed position and a document discharge position, although not shown specifically. A sheet conveying device, not shown, extends from the document set tray to the document stack tray via a scanning position on the glass platen 57 and includes a plurality of rollers.

The sheet bank 300 includes a plurality of sheet cassettes 61 arranged one above the other, and each is loaded with paper sheets, OHP (OverHead Projector) films or similar sheets or recording media S. Each sheet cassette 61 is provided with a pickup roller 62, a feed roller 63 and a reverse roller 64. The sheet path R1, also including a plurality of rollers, is arranged at the right-hand side of the sheet cassettes 61, as viewed in FIG. 6, and merges into the sheet path R of the copier body 100.

A manual sheet feed section 68 is arranged on the right side of the copier body 100, as viewed in FIG. 6, and includes an openable, manual sheet feed tray 67. The manual sheet feed path R2 mentioned earlier conveys a sheet set on the manual sheet feed tray 67 to the sheet path R. The manual sheet feed tray 67 is also provided with a pickup roller 62, a feed roller 63 and a reverse roller 64.

The operation of the illustrative embodiment will be described hereinafter. An operator, intending to copy a desired document, turns on a main switch, not shown, and sets the document on the document set tray of the ADF 400. In the case of a book document, the operator opens the ADF 400 upward, directly sets the document on the glass platen 57, and again closes the ADF 400.

When the operator, closed the ADF 400, presses a start switch, the ADF 400 conveys the document set thereon to the glass platen 57 via an ADF path with rollers. Then, the image scanner 200 is driven to read the document positioned on the glass platen 57. Subsequently, the DF 400 again conveys the document to the document stack tray.

On the other hand, when a document is directly laid on the glass platen 57 by hand, the image scanner 200 is immediately driven. More specifically, the light source 53 is moved along the glass platen 57 while illuminating the document. The resulting reflection from the document is sequentially reflected by the mirrors 54 and then incident to the image sensor 56 via the optical lens 55, so that the image sensor 56 reads the content of the document.

At the same time as the document reading operation stated above, the drum 10 is caused to rotate by a motor not shown. In this condition, the charger 11 uniformly charges the surface of the drum 10. Subsequently, the laser writing unit 47 scans the charged surface of the drum 10 with a laser beam modulated in accordance with image data output from the image scanner 200, thereby forming a latent image on the drum 10. The developing unit 12 deposits toner on the latent image to thereby produce a corresponding toner image.

Further, when the start switch is pressed, a sheet S of a desired size is paid out from any one of the sheet cassettes 61 by the pickup roller 62 associated with the sheet cassette 61. The sheet S thus paid out is conveyed to the sheet feed path R1 by the feed roller 63 while being separated from the underlying sheets S by the reverse roller 64. The sheet S is then conveyed to the sheet path R by the roller pair 66 until it has been stopped by the registration roller pair 21. The registration roller pair 21 again starts conveying the sheet S to the right-hand side of the drum 10 at such timing that the leading edge of the sheet S meets the leading edge of the toner image formed on the drum 10.

When the operator opens the manual sheet feed tray 67 of the manual sheet feed section 68 and then sets desired sheets on the tray 67, the top sheet S is paid out by the pickup roller 62 and then conveyed by the feed roller 63 to the manual sheet feed path R2 while being separated from the underlying sheets by the reverse roller 64. Subsequently, the sheet S is conveyed by the roller pair 66 to the sheet path R and then conveyed by the registration roller pair 21 to the right-hand side of the drum 10 in synchronism with the rotation of the drum 10.

At the image transfer position B mentioned earlier, the image transferring unit 13 transfers the toner image from the drum 10 to the sheet S brought to the right-hand side of the drum 10. The cleaning unit 14 removes the toner left on the drum 10 after the image transfer. Subsequently, a quenching lamp or similar discharger, not shown, removes potentials left on the drum 10 for thereby preparing the drum 10 for the next image forming operation.

The sheet or copy S, carrying the toner image thereon, is conveyed by the image transfer belt 17 to the fixing unit 22. The fixing unit 22 fixes the toner image on the sheet S with heat and pressure while conveying the sheet S. Finally, the sheet S is driven out to the stack section 39 while being provided with elasticity by the first and second press rollers 36 and 37 and stiffen roller 38.

In a duplex copy mode for transferring toner images to both sides of the sheet S, the path selector 34 is switched to steer the sheet or simplex copy S carrying the tone image on one surface from the sheet path R to the reverse path R3. The roller pair 66 on the reverse path R3 conveys the sheet S to the switchback position 44. The switchback roller pair 43 switches back the sheet S into the reefed path R4. As a result, the sheet S is turned over and again brought into the sheet path R by the roller pair 66, so that another toner image is transferred to the other surface of the sheet S in the same manner as the previous toner image.

Figure 7:
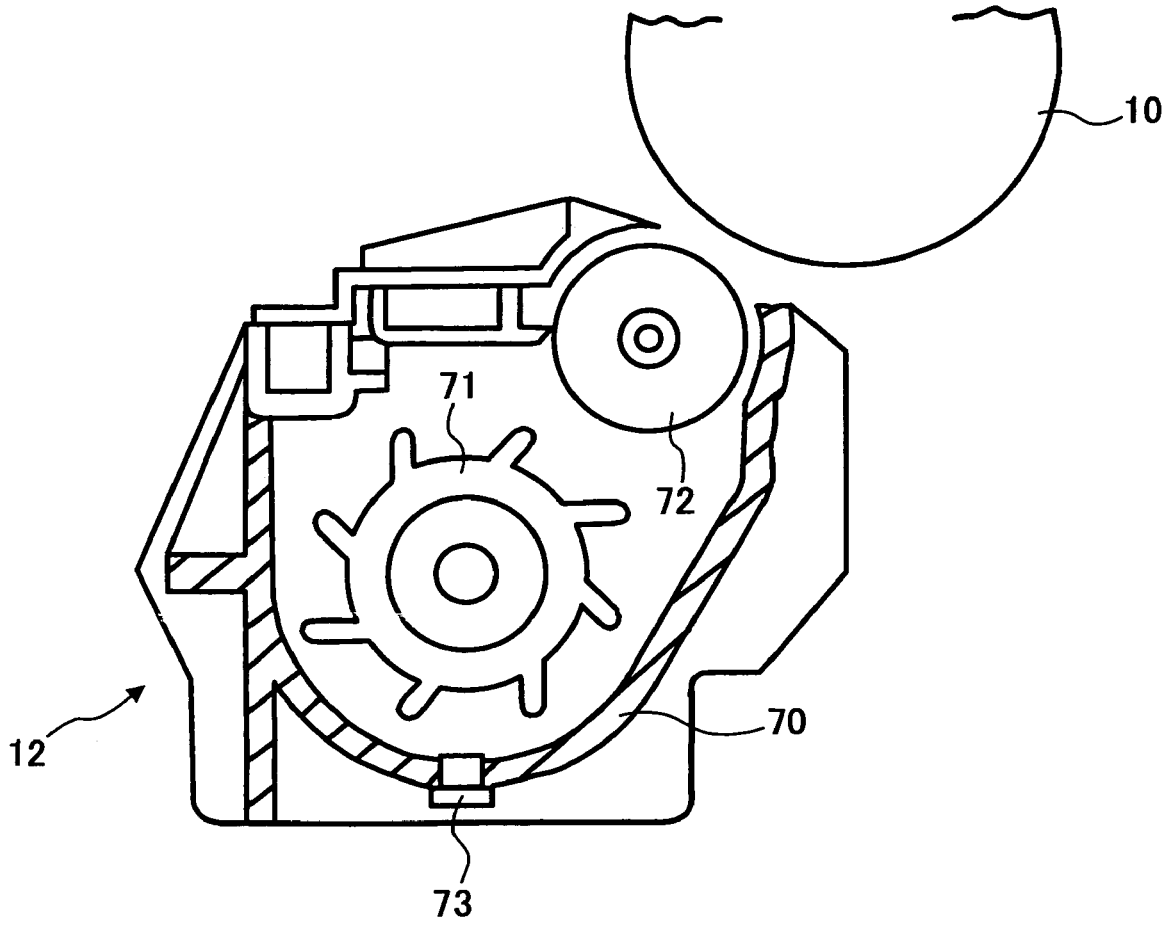
FIG. 7 is a front view showing a developing unit included in the illustrative embodiment.

FIG. 7 shows a specific configuration of the developing unit 12. As shown, the developing unit 12 includes a case 70 storing a two-component type developer, an agitator 71 for agitating the developer inside the case 70, and a developing roller 72 for feeding the developer to the drum 10. A toner content sensor or T sensor 73, playing the role of toner content sensing means, is mounted on the bottom of the case 70. A pattern density sensor or pattern density sensing means 74, see FIG. 8, adjoins the circumference of the drum 10.

The toner replenishing device 20 is loaded with a conventional toner bottle, not shown, which is a specific form of a toner cartridge and formed with a spiral groove protruding radially inward. When the toner bottle is rotated about its axis, fresh toner stored in the toner bottle is conveyed along the spiral groove in the lengthwise direction of the toner bottle and replenished to the case 70 of the developing unit 12. Replenishment ends when the toner bottle is caused to stop rotating.

Figure 8:
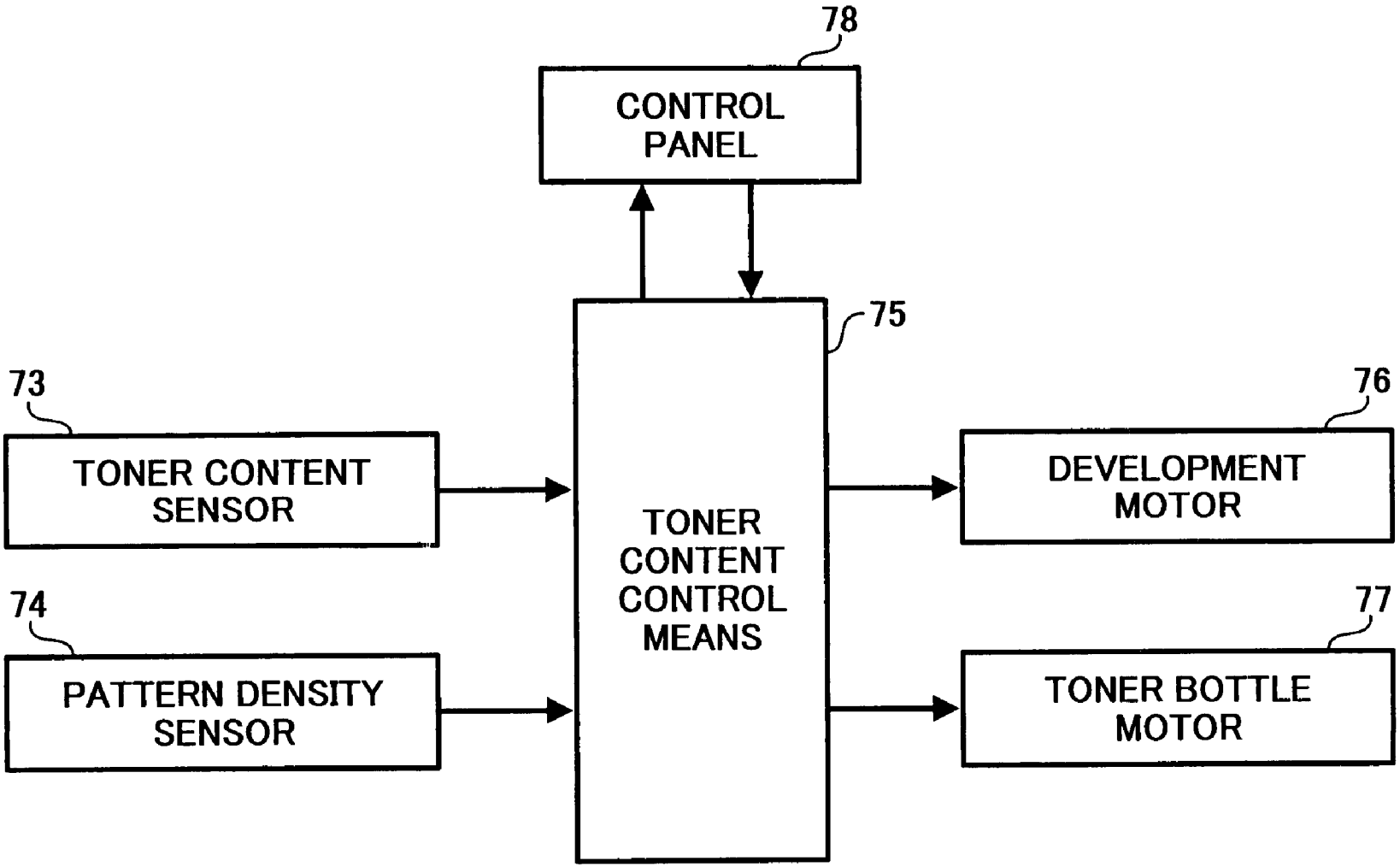
FIG. 8 is a block diagram schematically showing a control system included in the illustrative embodiment.

FIG. 8 shows a control system included in the illustrative embodiment. As shown, the control system includes toner content control means 75 implemented as a microcomputer including a CPU (Central Processing Unit), a ROM (Read Only Memory), a RAM (Random Access Memory), an I/O (Input/Output) interface and so forth. A main controller, included in the copier, may play the role of the toner content control means 75 at the same time, if desired. The output of the toner content sensor 73 and that of the pattern density sensor 74 are input to the toner content control means 75.

A development motor 76 drives the developing roller 72 and other members included in the developing unit 12 while a toner bottle motor 77 drives the toner bottle mounted on the toner replenishing device 20. The toner content control means 75 drives the two motors 76 and 77 in accordance with the outputs of the tone content sensor 73 and pattern density sensor 74. Also connected to the toner density control means 75 is a control panel 78.

The toner content sensor 73 measures the toner content of the developer stored in the case 70 in terms of the permeability of the developer, as stated previously. When a voltage Vt output from the toner content sensor 73 and therefore permeability is low, the toner content control means 75 determines that the toner content of the developer is high. Conversely, when the voltage Vt and therefore permeability is high, the toner control means 75 determines that the toner content is low.

More specifically, if the voltage Vt output from the toner content sensor 73 is higher than a preselected target or reference voltage Vtref, then the toner content control means 75 determines that the actual toner content is lower than a target toner content, and rotates the toner bottle for a preselected period of time for thereby replenishing fresh toner to the case 70. If the voltage Vt is lower than the target voltage Vtref, then the toner content control means 75 determines that the actual toner content is higher than the target toner content, and does not execute toner replenishment.

On the other hand, the target voltage Vtref assigned to the toner content sensor 73 is set in accordance with the density of a reference pattern formed on the drum 10. The reference pattern density increases with an increase in the toner content of the developer stored in the case 70 or decreases with a decrease in the same. Therefore, when the reference pattern density is low, the target voltage Vtref is lowered in order to shift the target toner content to the high content side. Conversely, when the reference pattern density is high, the target voltage Vtref is raised to shift the target toner content to the low density side. Such control is successful to confine the toner content of the developer in an adequate range.

In the illustrative embodiment, the toner content of the developer is sensed during image formation or between consecutive pages because it is desirable to sense it when the developer is being agitated. On the other hand, the density of the reference pattern, which is formed on the drum 10, is sensed between consecutive pages because it is impossible to sense it during image formation.

While the density of the reference pattern formed on the drum 10 is maintained constant by the procedure described above, it uncontrollably decreases when the toner bottle of the toner replenishing device 20 runs out of toner. In light of this, the toner content control means 75 senses the exhaustion of toner, i.e., a toner-end condition in accordance with the output of the toner content sensor 73 or that of the pattern density sensor 74.

Figure 9:
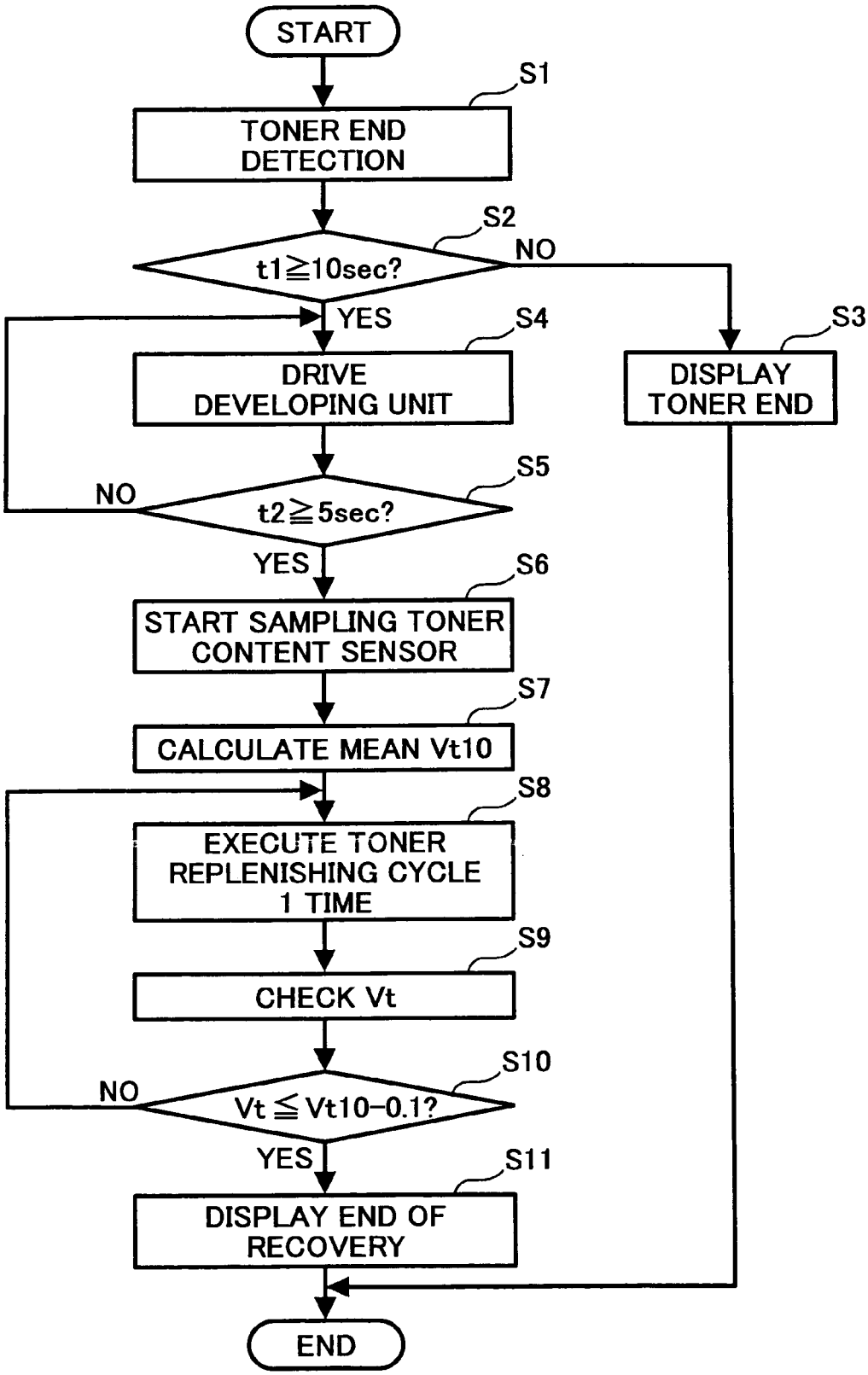
FIG. 9 is a flowchart demonstrating a specific operation of the illustrative embodiment.

A specific recovery procedure to be executed by the illustrative embodiment after the detection of a toner-end condition will be described with reference to FIG. 9. As shown, when the toner content control means 75 detects a toner-end condition (step S1), it causes the copier body 100 to stop operating. The toner content control means 75 then determines whether or nor a cover, not shown, has been opened for a period of time t1, which is equal to or longer than 10 seconds, for replacing the toner cartridge or toner bottle (step S2). For this decision, use is made of a signal output from a switch, not shown, interlocked to the opening/closing of the cover.

If the answer of the step S2 is negative (no), the toner content control means 75 determines that the toner cartridge is not replaced, displays a message indicative of the toner-end condition on, e.g., an LCD (Liquid Crystal Display) included in the control panel 78 (step S3), and then ends the recovery procedure. The LCD may, of course be replaced with an indicator that selectively turns on or turns off.

If the answer of the step S2 is positive (yes), the toner content control means 75 determines that the toner cartridge has been replaced with a new toner cartridge, and then drives the developing unit 12 to agitate the developer present in the case 70 (step S4). Subsequently, the toner content control means 75 determines whether or not a period of time t2, which is equal to or longer than 5 seconds, has elapsed since the start of drive of the developing unit 12 (step S5). If the answer of the step S5 is yes, the toner content control means 75 starts sampling the output voltage Vt of the toner content sensor 73, which is stable then (step S6). If the answer of the step S5 is no, the procedure returns to the step S4.

After the step S6, the toner content control means 75 calculates a mean value of the voltage Vt sampled ten consecutive times, thereby producing Vt10-0.1 V, which is the target value of the toner content sensor 73, for determining that the toner-end recovery procedure has completed (step S7). Subsequently, every time a toner replenishing cycle, which consists of 1 second of toner replenishment and 9 seconds of agitation following it, is executed (step S8), the toner content control means 75 checks the output voltage Vt of the toner content sensor 73 (step S9) to see if Vt has decreased to or below Vt10-0.1 (step S10). If the answer of the step S10 is yes, the toner content control means 75 determines that the toner recovery procedure has completed, displays a corresponding message on the LCD (S11), and then ends the procedure. If the answer of the step S10 is no, the operation returns to the step S8.

Figure 10:
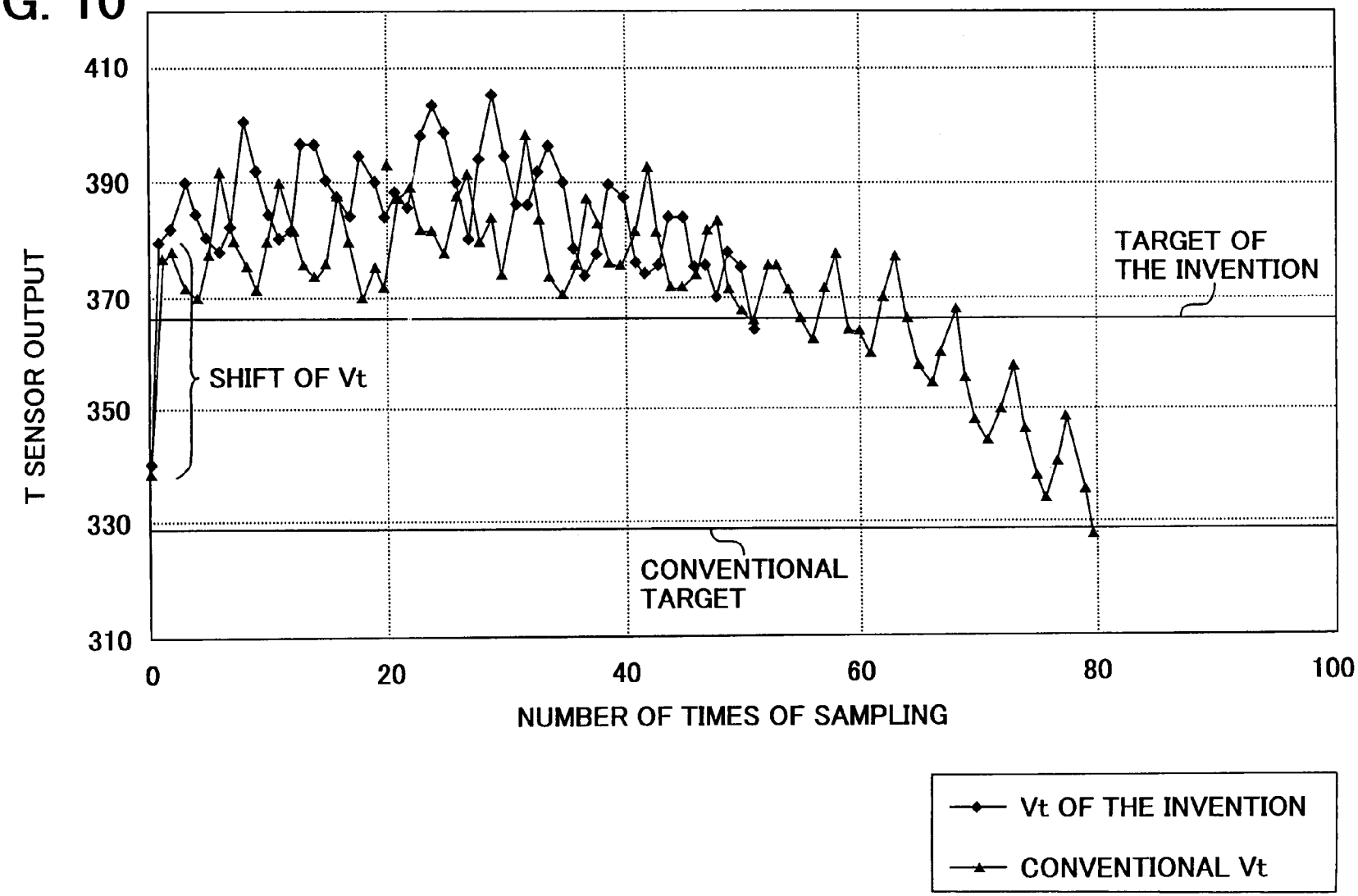
FIG. 10 is a graph comparing the illustrative embodiment and prior art as to a relation between the output of a toner content sensor and the number of times of sampling.

FIG. 10 is a graph comparing the unique control procedure described above and conventional control as to the output of a toner content sensor. As shown, in accordance with the conventional control, the output voltage Vt10 is 3.40 V just after the detection of a toner-end condition, so that a recovery operation ends when the voltage Vt is 3.30 V or below. However, the voltage Vt10 rises to 3.80 V during a long interval between operations. Consequently, fresh toner is replenished in such a manner as to compensate for such a shift and therefore in an excessive amount, resulting in background contamination. By contrast, the illustrative embodiment uses the voltage Vt10 after the above interval as a reference and can therefore end the recovery procedure without making the toner content excessively high.

Figure 11:
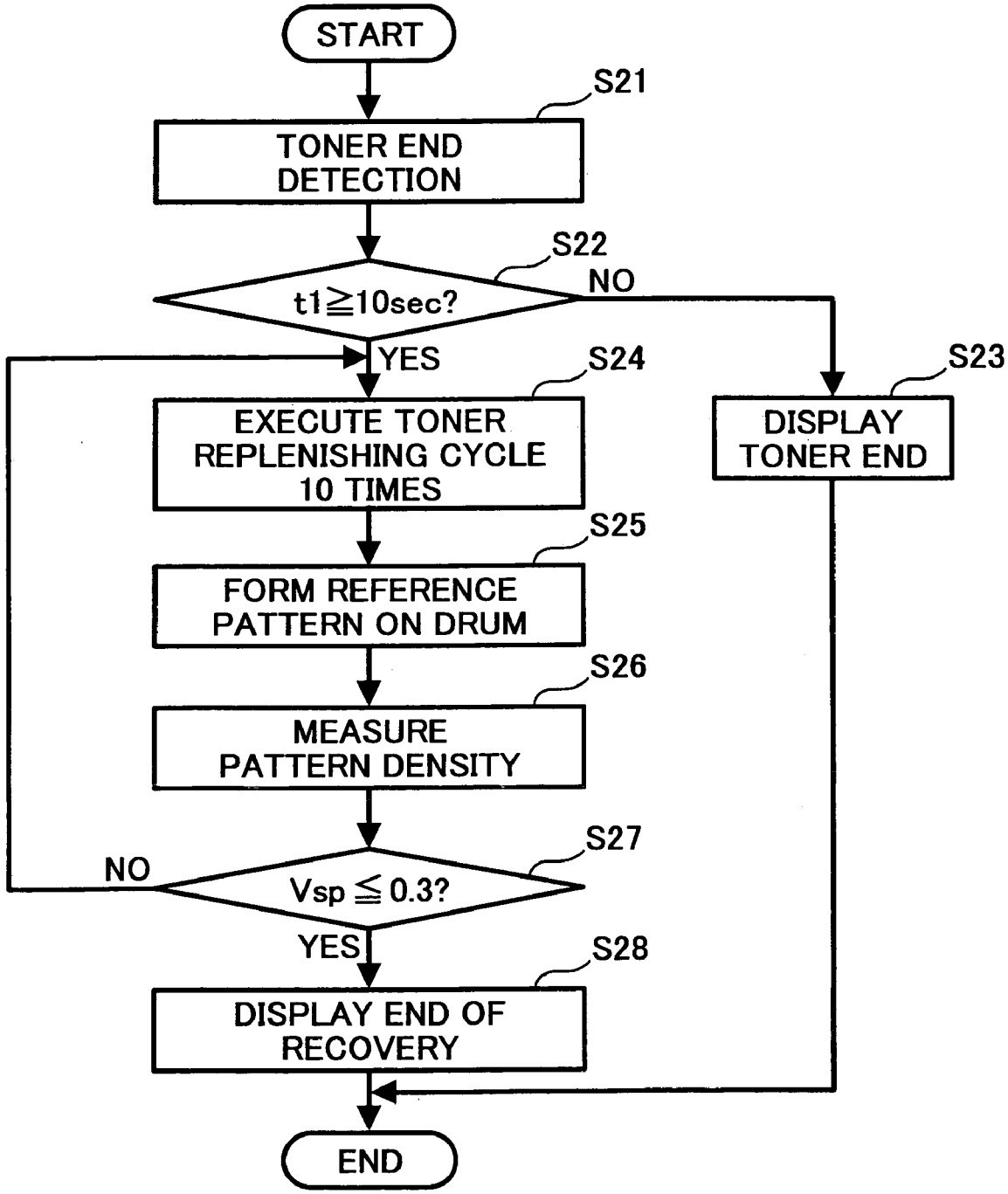
FIG. 11 is a flowchart showing an alternative embodiment of the present invention.
Figure 12:
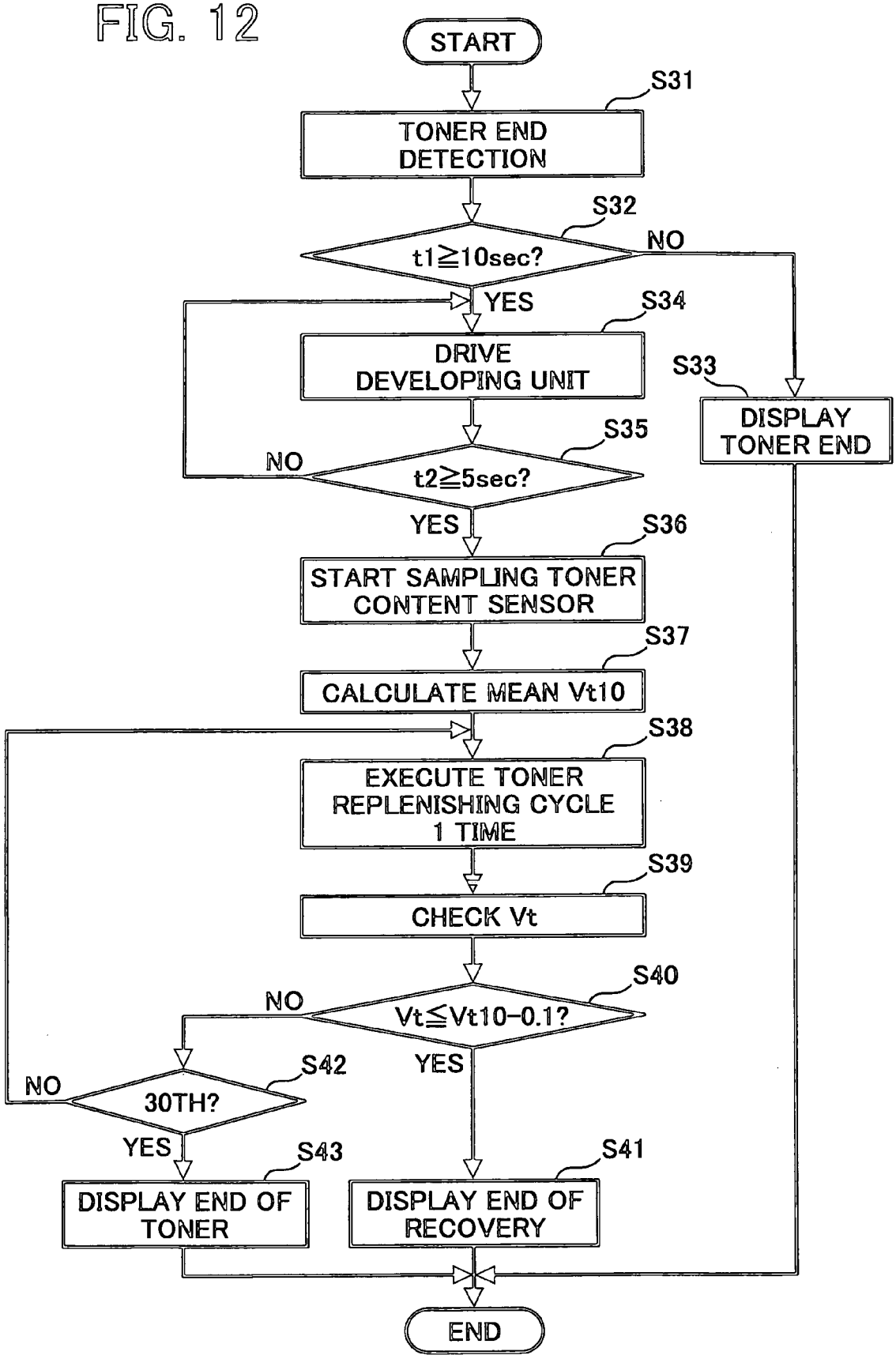
FIG. 12 is a flowchart showing another alternative embodiment of the present invention.

Reference will be made to FIG. 11 for describing an alternative embodiment of the present invention. The alternative embodiment is practicable with arrangements essentially similar to the arrangements of the previous embodiment. This is also true with the other alternative embodiments to be described later.

As shown in FIG. 11, when the toner content control means 75 detects a toner-end condition (step S21), it causes the copier body 100 to stop operating. The toner content control means 75 then determines whether or nor a cover, not shown, has been opened for a period of time t1, which is equal to or longer than 10 seconds, for replacing the toner cartridge or toner bottle (step S22). If the answer of the step S22 is no, the toner content control means 75 determines that the toner cartridge is not replaced, displays a message indicative of the toner-end condition on the LCD included in the control panel 78 (step S23), and then ends the recovery procedure.

If the answer of the step S22 is yes, the toner content control means 75 determines that a new toner cartridge has been set, and repeats the previously mentioned toner replenishing cycle ten consecutive times (step S24). Subsequently, the toner content control means 75 forms a reference pattern on the drum 10 (step S25), measures the density VsP of the reference pattern (step S26), and then determines whether or not the measured density VsP is lower than 0.3 inclusive (step S27). If the answer of the step pS27 is no, the toner content control means 75 determines that the toner content is short, and again executes the step S24.

If the answer of the step S27 is yes, the toner content control means 75 determines that the recovery procedure has completed, and displays the end of recovery on the LCD (step S28). The conventional control replenishes toner by taking account of the shift of the voltage Vt also and therefore brings about background contamination ascribable to an excessively high toner content. By determining an amount of toner to replenish in accordance with the density of a reference pattern formed on the drum 10, the illustrative embodiment is capable of obviating excessive toner replenishment even if the sensitivity of the toner content sensor 73 noticeably varies due to the long interval between operations.

Figure 13:
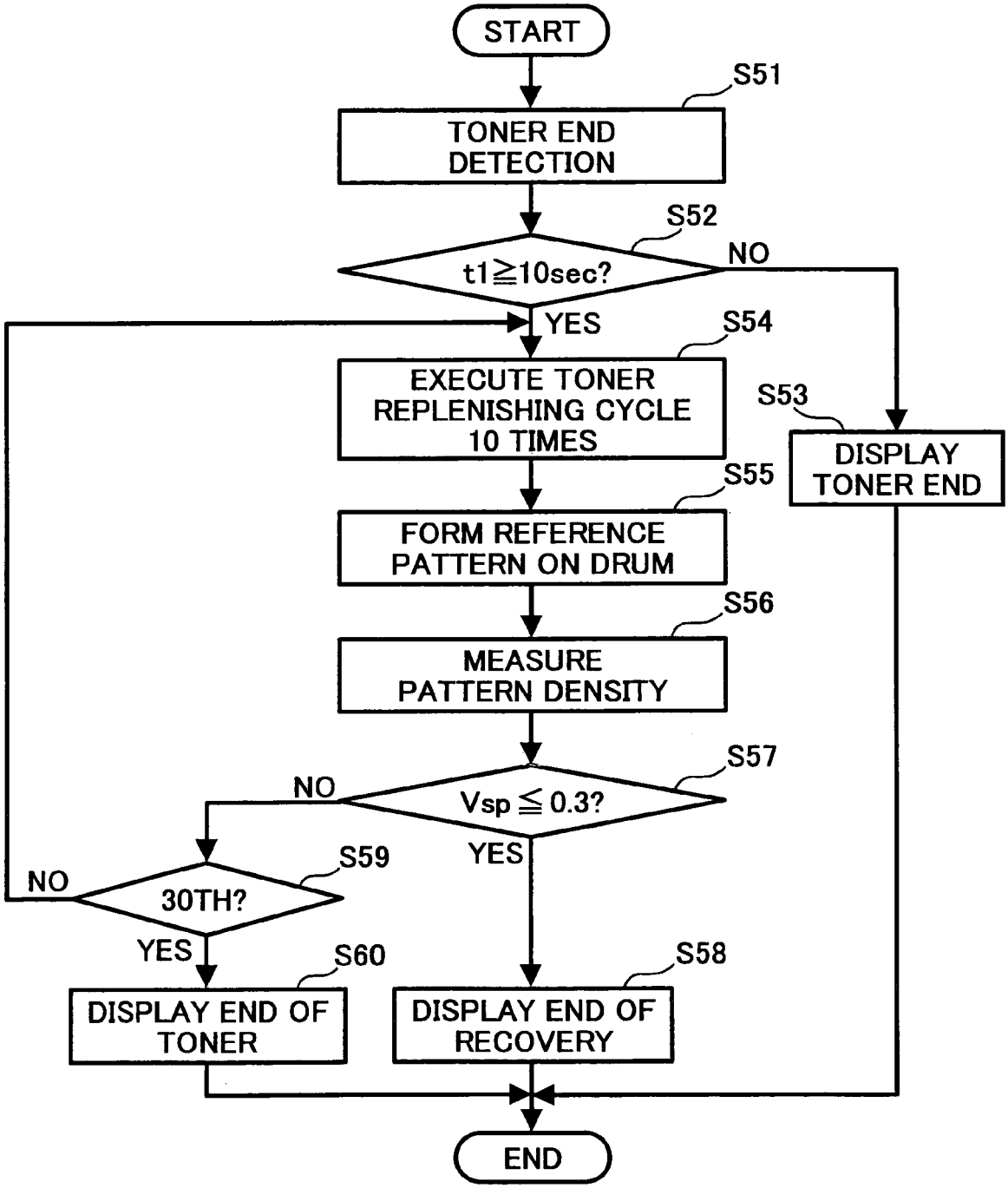
FIG. 13 is a flowchart showing a further alternative embodiment of the present invention.

FIG. 13 shows another alternative embodiment of the present invention. As shown, when the toner content control means 75 detects a toner-end condition (step S31), it causes the copier body 100 to stop operating. The toner content control means 75 then determines whether or nor a cover, not shown, has been opened for a period of time t1, which is equal to or longer than 10 seconds, for replacing the toner cartridge or toner bottle (step S32).

If the answer of the step S32 is no, the toner content control means 75 determines that the toner cartridge is not replaced, displays a message indicative of the toner-end condition on the LCD included in the control panel 78 (step S33), and then ends the recovery procedure.

If the answer of the step S32 is yes, the toner content control means 75 determines that the toner cartridge has been replaced with a new toner cartridge, and then drives the developing unit 12 to agitate the developer present in the case 70 (step S34). Subsequently, the toner content control means 75 determines whether or not a period of time t2, which is equal to or longer than 5 seconds, has elapsed since the start of drive of the developing unit 12 (step S35). If the answer of the step S35 is yes, the toner content control means 75 starts sampling the output voltage Vt of the toner content sensor 73, which is stable then (step S36). If the answer of the step S35 is no, the procedure returns to the step S34.

After the step S36, the toner content control means 75 calculates a mean value of the voltage Vt sampled ten consecutive times, thereby producing Vt10 -0.1 V, which is the target value of the toner content sensor 73, for determining that the toner-end recovery procedure has completed (step S37). Subsequently, every time the previously mentioned toner replenishing cycle is executed (step S38), the toner content control means 75 checks the output voltage Vt of the toner content sensor 73 (step S39) to see if Vt has decreased to or below Vt10 -0.1 (step S40). If the answer of the step S40 is yes, the toner content control means 75 determines that the toner recovery procedure has completed, displays a corresponding message on the LCD (S41), and then ends the procedure.

If the answer of the step S40 is no, the toner content control means 75 determines whether or not the toner replenishing cycle is the thirtieth cycle (step S42). If the, answer of the step S42 is yes, the toner content sensor 75 displays a toner-end condition on the LCD (step S43) and then ends the procedure. If the answer of the step S42 is no, the procedure returns to the step S38. With the sequence of steps described above, the illustrative embodiment can determine, even when the empty toner cartridge is again mounted to the apparatus, that toner is absent and stops the image forming operation. This is successful to control carrier deposition.

FIG. 13 demonstrates a further alternative embodiment of the present invention. When the toner content control means 75 detects a toner-end condition (step S51), it causes the copier body 100 to stop operating. The toner content control means 75 then determines whether or nor a cover, not shown, has been opened for a period of time t1, which is equal to or longer than 10 seconds, for replacing the toner cartridge or toner bottle (step S52). If the answer of the step S52 is no, the toner content control means 75 determines that the toner cartridge is not replaced, displays a message indicative of the toner-end condition on the LCD included in the control panel 78 (step S53), and then ends the recovery procedure.

If the answer of the step S52 is yes, the toner content control means 75 determines that a new toner cartridge has been set, and repeats the previously mentioned toner replenishing cycle ten consecutive times (step S54). Subsequently, the toner content control means 75 forms a reference pattern on the drum 10 (step S55), measures the density VsP of the reference pattern (step S56), and then determines whether or not the measured density VsP is lower than 0.3 inclusive (step S57) If the answer of the step S57 is yes, the toner content control means 75 determines that the toner recovery procedure has completed, displays a corresponding message on the LCD (S58), and then ends the procedure.

If the answer of the step S57 is no, the toner content control means 75 determines whether or not the toner replenishing cycle is the thirtieth cycle (step S59). If the answer of the step S59 is yes, the toner content sensor 75 displays a toner-end condition on the LCD (step S60) and then ends the procedure. If the answer of the step S59 is no, the procedure returns to the step S54. With the sequence of steps described above, the illustrative embodiment can also determine, even when the empty toner cartridge is again mounted to the apparatus, that toner is absent and stops the image forming operation. This is successful to control carrier deposition.

In summary, it will be seen that the present invention provides an image forming apparatus having various unprecedented advantages, as enumerated below.

(1) A toner-end recovery procedure can be ended without making the toner content of a developer excessively high.

(2) Even when an empty toner cartridge is again mounted to the apparatus, it is possible to stop image formation by detecting the absence of toner, thereby protecting the apparatus from damage ascribable to carrier deposition.

(3) Excessive toner replenishment is obviated even when the sensitivity of a toner content sensor noticeably varies while the apparatus is left unused for a substantial period of time.

(4) It is possible to maintain, while making the most of the property of toner formed of denatured polyester resin, an adequate toner content even after the recovery operation for thereby obviating background contamination and other image defects as well as toner scattering.

Various modifications will become possible for those skilled in the art after receiving the teachings of the present disclosure without departing from the scope thereof.

What is claimed is:

1. An image forming apparatus comprising:

a developing unit configured to develop a latent image formed on an image carrier with toner to thereby produce a corresponding toner image;

toner replenishing means including a removable toner cartridge for replenishing toner to said developing unit;

toner content sensing means for sensing a toner content of a developer stored in said developing unit in terms of permeability of said developer;

pattern density sensing means for sensing a reflection density of a reference pattern formed on said image carrier; and toner content control means for calculating, based on an output of said pattern density sensing means, a target value of said toner content sensing means and so controlling said toner replenishing means as to implement said target value;

said toner content control means being capable of determining that said toner replenishing means has run out of toner and that the toner cartridge has been replaced;

said toner content control means setting the target value for determining, after said developing unit has been driven for a preselected period of time since detection of a replacement of the toner cartridge, that a toner-end recovery operation is completed.

2. The apparatus as claimed in claim 1, wherein said toner content control means determines, if the target value of said toner content sensing means is not reached even after the toner-end recovery operation has been executed for a preselected period of time, that a used toner cartridge is again set, again displays a toner-end condition, and inhibits image formation from being performed.

3. The apparatus as claimed in claim 1, wherein the toner is produced by dissolving or dispersing denatured polyester resin, which is reactive to a compound including an active hydrogen radical, a colorant and a parting agent in an organic solvent, dispersing a resulting solution or a resulting dispersion in a water medium containing fine resin grains, causing a resulting dispersion to react with at least one of a cross-linker and an extending agent, removing said organic solvent from a resulting dispersion, and removing said fine resin grains from surfaces of toner grains by rinsing.

4. An image forming apparatus comprising:

a developing unit configured to develop a latent image formed on an image carrier with toner to thereby produce a corresponding toner image;

toner replenishing means including a removable toner cartridge for replenishing toner to said developing unit;

toner content sensing means for sensing a toner content of a developer stored in said developing unit in terms of permeability of said developer;

pattern density sensing means for sensing a reflection density of a reference pattern formed on said image carrier; and toner content control means for calculating, based on an output of said pattern density sensing means, a target value of said toner content sensing means and so controlling said toner replenishing means as to implement said target value;

said toner content control means being capable of determining that said toner replenishing means has run out of toner and that the toner cartridge has been replaced;

said toner content control means starting, on detecting a replacement of the toner cartridge, a toner-end recovery operation, checking an output of said pattern density sensing means every time said toner replenishing means continuously performs a toner replenishing operation for a preselected period of time, and determining that said toner-end recovery operation has completed when said output of said pattern density sensing means exceeds a preselected threshold value.

5. The apparatus as claimed in claim 4, wherein said toner content control means determines, if the target value of said toner content sensing means is not reached even after the toner-end recovery operation has been executed for a preselected period of time, that a used toner cartridge is again set, again displays a toner-end condition, and inhibits image formation from being performed.

6. The apparatus as claimed in claim 4, wherein the toner is produced by dissolving or dispersing denatured polyester resin, which is reactive to a compound including an active hydrogen radical, a colorant and a parting agent in an organic solvent, dispersing a resulting solution or a resulting dispersion in a water medium containing fine resin grains, causing a resulting dispersion to react with at least one of a cross-linker and an extending agent, removing said organic solvent from a resulting dispersion, and removing said fine resin grains from surfaces of toner grains by rinsing.

* * * * *